US010337845B2

(12) United States Patent
Jansson

(10) Patent No.: US 10,337,845 B2
(45) Date of Patent: Jul. 2, 2019

(54) SUPPORTING DEVICE FOR DIVIDABLE PARACHUTE GRENADE

(71) Applicant: BAE SYSTEMS BOFORS AB, Karlskoga (SE)

(72) Inventor: Håkan Jansson, Karlskoga (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 0 days.

(21) Appl. No.: 16/094,028

(22) PCT Filed: Apr. 18, 2017

(86) PCT No.: PCT/SE2017/050383
§ 371 (c)(1),
(2) Date: Oct. 16, 2018

(87) PCT Pub. No.: WO2017/184065
PCT Pub. Date: Oct. 26, 2017

(65) Prior Publication Data

US 2019/0086188 A1 Mar. 21, 2019

(30) Foreign Application Priority Data

Apr. 20, 2016 (SE) ..... 1630094

(51) Int. Cl.
*F42B 10/56* (2006.01)
*F42B 12/62* (2006.01)

(52) U.S. Cl.
CPC ..... *F42B 10/56* (2013.01); *F42B 12/625* (2013.01)

(58) Field of Classification Search
CPC .. F42B 4/22; F42B 15/36; F42B 15/38; F42B 10/56; F42B 12/62; F42B 12/625;
(Continued)

(56) References Cited

U.S. PATENT DOCUMENTS 1,589,277 A * 6/1926 Wiley ..... F42B 10/56 102/337
2,717,309 A 9/1955 Campbell
(Continued)

FOREIGN PATENT DOCUMENTS

DE 283374 4/1913
DE 3743840 A1 7/1989
(Continued)

OTHER PUBLICATIONS

International Search Report (dated Jun. 13, 2017) for corresponding International App. PCT/SE2017/050383.

*Primary Examiner* — Derrick R Morgan
(74) *Attorney, Agent, or Firm* — WRB-IP LLP

(57) ABSTRACT

A dividable parachute grenade is provided including a grenade casing, a nose cone, a detonating fuse, a dividing charge, a payload, a parachute device, a grenade bottom, and a supporting device, wherein the supporting device is annular and includes pretensioned sector elements fixed to a fixing ring in the recess on the inner side of the grenade casing, the sector elements are pretensioned with a tension ring arranged around the annular supporting device via recessed grooves in the sector elements, whereof the supporting device is arranged extensibly in the radial direction in a recess on the inner side of the grenade casing behind the payload and supports the payload in the extended position during the acceleration phase of the grenade, and stays in the grenade after the separation of the payload from the grenade.

3 Claims, 3 Drawing Sheets

(58) Field of Classification Search
CPC ..... F42B 12/64; F42B 12/40; F42B 12/42; F42B 12/44; F42B 12/70
See application file for complete search history.

(56) References Cited

U.S. PATENT DOCUMENTS 3,038,407 A * 6/1962 Robertson ..... F42B 10/56 102/340
3,055,300 A * 9/1962 Stoehr ..... F42B 4/12 102/339
3,071,188 A * 1/1963 Raulins ..... E21B 33/038 166/340
3,096,999 A * 7/1963 Ahlstone ..... E21B 33/038 166/340
3,120,402 A * 2/1964 Wallen ..... F16L 37/101 220/315
3,222,088 A * 12/1965 Haeber ..... E21B 33/038 166/344
3,487,781 A * 1/1970 Oss ..... F42B 10/56 102/377
3,502,023 A 3/1970 Britton
3,505,925 A * 4/1970 Carr ..... B64D 1/02 102/378
3,628,812 A * 12/1971 Larralde ..... F16L 37/133 285/24
3,839,962 A 10/1974 Popovitch et al.
3,863,569 A * 2/1975 Simmons ..... F42B 10/56 102/340
4,119,037 A * 10/1978 Romer ..... F42B 12/62 102/489
4,120,519 A * 10/1978 Bridges ..... F42B 15/36 285/3
4,184,242 A * 1/1980 Petrie ..... B21D 53/20 140/88
4,191,406 A * 3/1980 Eaton ..... F16L 37/121 285/315
4,226,185 A * 10/1980 Tobler ..... F42B 10/56 102/340
4,337,971 A * 7/1982 Kendrick ..... F16L 37/121 285/315
4,373,753 A * 2/1983 Ayers ..... F16L 37/133 285/319
4,433,859 A * 2/1984 Driver ..... E21B 33/038 285/315
4,516,499 A * 5/1985 Eyman ..... F42B 15/36 102/293
4,557,508 A * 12/1985 Walker ..... E21B 33/038 285/84
4,632,010 A * 12/1986 Humphries ..... F42B 10/56 102/387
4,790,571 A * 12/1988 Montanari ..... F16L 37/133 285/86
4,833,993 A 5/1989 Garcia-Garcia
4,889,030 A * 12/1989 Grosswendt ..... F42B 15/36 89/1.14
4,902,045 A * 2/1990 McGugan ..... E21B 33/038 285/24
4,920,887 A 5/1990 Frehaut et al.
5,103,734 A * 4/1992 Arnaud ..... F42B 12/62 102/293
5,157,816 A * 10/1992 Huessler ..... B64G 1/641 24/279
5,183,962 A * 2/1993 Karius ..... F42B 30/003 102/293
5,277,460 A * 1/1994 Grainge ..... F16B 7/0406 285/309
5,299,503 A 4/1994 Frehaut et al.
5,318,255 A * 6/1994 Facciano ..... F42B 15/36 102/378
5,370,057 A * 12/1994 Badura ..... F42B 12/625 102/378
5,386,781 A * 2/1995 Day ..... F42B 4/28 102/337
5,394,803 A * 3/1995 Mort ..... F02K 9/38 102/377
6,142,424 A * 11/2000 Wagner ..... B64G 1/641 102/377
6,227,493 B1 * 5/2001 Holemans ..... B64G 1/641 244/173.1
6,321,656 B1 * 11/2001 Johnson ..... F42B 39/20 102/377
6,609,734 B1 * 8/2003 Baugh ..... E21B 33/038 285/123.13
8,317,234 B2 * 11/2012 McKay ..... E21B 33/038 285/81
8,408,136 B1 * 4/2013 Lee ..... F42B 15/36 102/377
8,616,131 B2 * 12/2013 Kaddour ..... F42B 39/20 102/377
8,757,671 B2 * 6/2014 Pallini, Jr. ..... E21B 17/043 285/322
9,255,453 B1 * 2/2016 Jennings ..... E21B 17/085
9,528,802 B1 * 12/2016 Markowitch ..... F42B 12/36
9,923,302 B2 * 3/2018 Friesen ..... H01R 13/5202
10,030,953 B2 * 7/2018 Adams ..... F42B 4/28
10,094,501 B2 * 10/2018 Bull ..... E21B 33/038
2001/0009634 A1 * 7/2001 Giesenberg ..... F42B 15/36 403/338
2003/0168857 A1 * 9/2003 Jennings ..... F16L 37/002 285/322
2004/0057787 A1 * 3/2004 Cleveland ..... B64G 1/641 403/374.1
2004/0226474 A1 * 11/2004 Comtesse ..... B64G 1/645 102/378
2005/0001427 A1 * 1/2005 Liew ..... E21B 33/038 285/322
2005/0146137 A1 * 7/2005 Davidson ..... E21B 33/038 285/322
2005/0193916 A1 * 9/2005 Cleveland ..... B64G 1/645 102/378
2005/0279890 A1 * 12/2005 Holemans ..... B63B 21/08 244/171.3
2008/0011180 A1 * 1/2008 Stimpson ..... F42B 15/36 102/377
2010/0050897 A1 * 3/2010 Kim ..... F42B 15/36 102/377
2011/0036261 A1 * 2/2011 Krisher ..... F42B 10/46 102/378
2011/0044751 A1 * 2/2011 Diehl ..... F16L 35/00 403/2
2013/0011189 A1 * 1/2013 Kamiya ..... F16B 7/0426 403/338
2013/0199359 A1 * 8/2013 Kister ..... F42B 15/38 89/1.14
2015/0211832 A1 * 7/2015 Travis ..... F42B 15/36 285/90
2016/0033069 A1 * 2/2016 Buttolph ..... F16L 37/101 403/320
2017/0341782 A1 * 11/2017 Rivas S nchez ..... B64G 1/641
2019/0086188 A1 * 3/2019 Jansson ..... F42B 12/625

FOREIGN PATENT DOCUMENTS

DE 4001767 C1 5/1998
EP 0195854 A1 10/1986
GB 19069 8/1913
GB 1050229 12/1966
GB 2517445 A 2/2015

* cited by examiner

SUPPORTING DEVICE FOR DIVIDABLE PARACHUTE GRENADE

BACKGROUND AND SUMMARY

The present invention relates to a supporting device for a payload in a dividable parachute grenade.

In order to support a payload in a dividable parachute grenade during the acceleration phase of the grenade and prevent the payload from being pressed against the parachute, which makes division of the grenade more difficult, the parachute is normally arranged in a supporting cylinder which extends from the back of the grenade to the back plane of the payload. The supporting cylinder is usually constituted by two steel tube halves, which, after division of the grenade, are released from the grenade and fall down to the ground, which poses a risk to humans in the area.

It is desirable to provide a supporting device for a payload in a dividable parachute grenade, configured to prevent the payload from being pressed against the parachute during the acceleration phase of the grenade, at the same time as the supporting device is safe for the environment after the separation of the payload from the grenade.

It is also desirable to provide a simple supporting device having few parts.

Thus, according to an aspect of the present invention, a supporting device for a payload in a dividable parachute grenade comprising a grenade casing, a nose cone, a detonating fuse, a dividing charge, a payload, a parachute device, a grenade bottom, and a supporting device arranged between the payload and the parachute device.

Characteristic of an aspect of the invention is that the supporting device is arranged extensibly in the radial direction in a recess on the inner side of the grenade casing behind the payload, wherein the supporting device supports the payload in the extended position during the acceleration phase of the grenade. After muzzle passage and setback, the rotation of the grenade causes the supporting device to open and remain in the grenade after the separation of the payload from the grenade.

According to a second embodiment of an aspect of the invention, the supporting device is annular and comprises pretensioned sector elements which are fixed to a fixing ring in the recess on the inner side of the grenade casing.

According to a third embodiment of an aspect of the invention, the sector elements are pretensioned via an elastic tension ring, which is arranged around the annular supporting device via recessed grooves in the sector elements.

According to a fourth embodiment of an aspect of the invention, the sector elements are curved in the radial direction and conical in the axial direction. The sector elements comprise a rear end face, closest to the parachute device, comprising hollow bushings in the radial direction for fixing of the sector elements via the fixing ring. The front end face of the sector elements, closest to the payload, comprises recessed grooves for application of the resilient tension ring.

According to a fifth embodiment of an aspect of the invention, the sector elements are pretensioned via torsion springs arranged in the recess on the inner side of the grenade casing.

The invention, according to aspects thereof, yields a number of advantages and effects, of which the most important are as follows:

By replacing the cylindrical container with an extensible supporting device arranged in a recess on the inner side of the grenade casing behind the payload, a smaller and lighter supporting device, which stays in the grenade after separation of the payload, parachute and grenade bottom of the grenade, is obtained.

BRIEF DESCRIPTION OF THE DRAWINGS

Further advantages and effects of the invention will emerge during study and consideration of the following, detailed description of the invention, with simultaneous reference to FIGS. 1-7 of the drawing, in which.

DETAILED DESCRIPTION

In a conventional embodiment of a dividable parachute grenade, the parachute device is arranged in a cylindrical steel container, which supports the payload and prevents it from being pressed against the parachute device during the acceleration phase of the grenade. The cylindrical steel container, which is dividable into two similar halves, is released after the division and falls down to the ground.

By replacing the cylindrical steel container with a supporting device which is mounted in the inner side of the grenade casing, a situation in which this is released upon division and falls down to the ground is avoided. The said supporting device is arranged extensibly in the radial direction in a recess on the inner side of the grenade casing behind the payload, which results in a smaller and lighter supporting device which stays in the grenade after the division of the grenade.

The proposed supporting device can be likened to a locking chuck which opens and closes during the various phases of the grenade, i.e. during the acceleration and division/rotation phase of the grenade. Upon mounting of the payload, the chuck springs apart and admits the payload into the grenade case. Once the payload has passed through the chuck, the pretension in a tension ring causes the chuck to spring/be lowered out of the recess and to close behind the payload.

The acceleration in the barrel and the angle of the contact surface between payload and supporting device has the effect that the chuck supports the back plane of the payload and prevents this from moving backwards towards the parachute. After muzzle passage and setback, the rotation of the grenade causes the chuck to spring/be lowered into the recess, to open, and to remain thus during the rest of the flight of the grenade.

Figure 1:
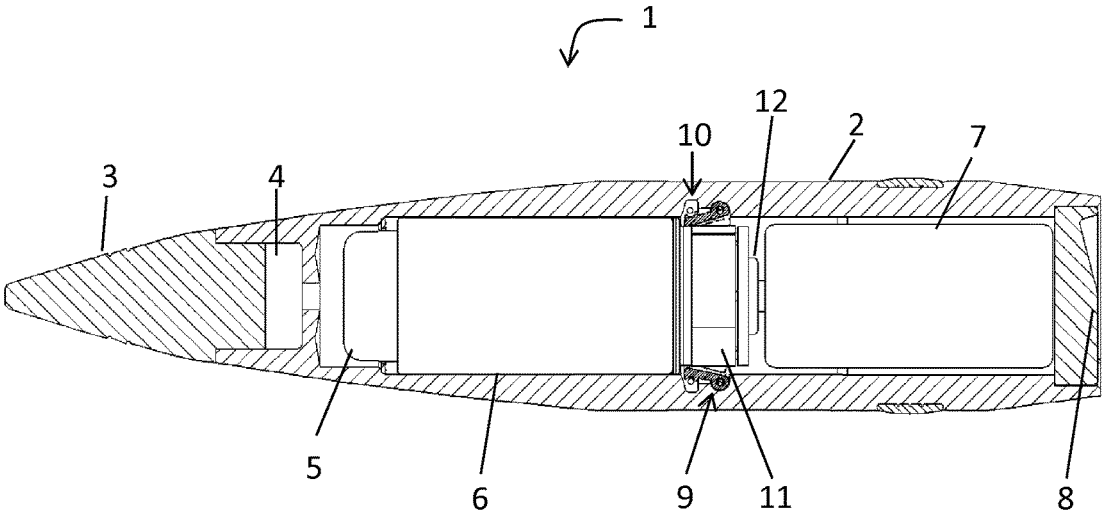
FIG. 1 shows schematically a longitudinal section of a pretensioned extensible supporting device in the extended position, arranged in a dividable grenade comprising a nose cone, a detonating fuse, a grenade casing, a dividing charge, a payload, a parachute device and a grenade bottom.

FIG. 1 shows a longitudinal section of a dividable parachute grenade 1, comprising a grenade casing 2, a nose cone 3, a detonating fuse 4, a dividing charge 5, a payload 6, a parachute device 7, a grenade bottom 8 and a supporting device 9 which is arranged recessed on the inner side of the grenade case 2 between the payload 6 and the parachute device 7. The payload 6 can be constituted, for example, by a flare or a smoke generator.

FIGS. 2-7 show a first embodiment of an annular supporting device 9 which is arranged extensibly in the radial direction in a turned-out recess 10 on the inner side of the grenade case 2. The recess 10 is realized such that the cross section corresponds to the cross section of the supporting device 9.

The weight of the supporting device 9 maximally corresponds to the weight of the material from the turned-out recess. The weight of the grenade 1 is therefore reduced at least by a weight corresponding to the weight of the two steel tube halves. The reduced weight can be exploited, for example, for a larger payload or a larger parachute.

Figure 5:
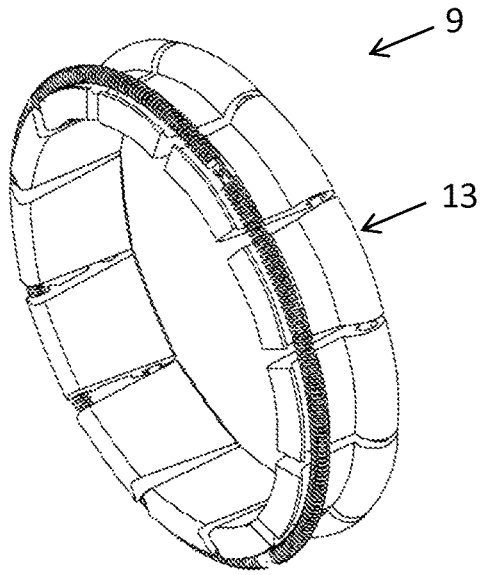
FIG. 5 shows schematically a detailed view of a pretensioned annular supporting device comprising sector elements, fixing ring and pretensioning wire in the extended position during the acceleration phase, according to FIG. 1.
Figure 6:
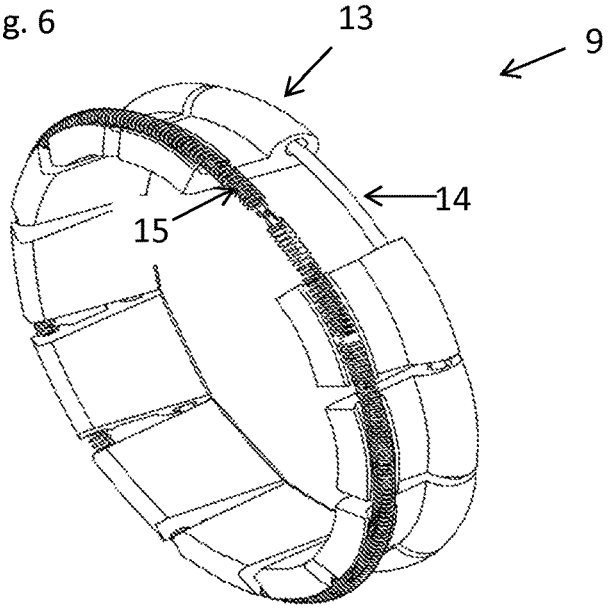
FIG. 6 shows schematically a detailed view of a pretensioned annular supporting device comprising sector elements, fixing ring and pretensioning wire, in the retracted position during the division phase of the grenade, according to FIG. 1.

The annular supporting device 9. FIGS. 5-6, is sectioned into a number of sector elements 13, preferably twelve sector elements 13, which are fixed to a fixing ring 14 via radial hollow bushings 18 in the sector elements 13. The fixing ring 14 is preferably made of a resilient steel material, but can also be made of a composite material, such as, for example, a reinforced carbon fibre material.

Figure 7:
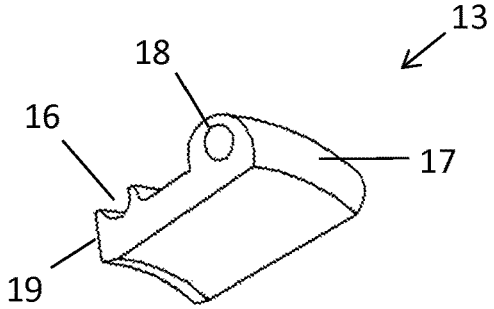
FIG. 7 shows schematically a detailed view of a sector element, according to FIG. 1.

The sector elements 13 are curved in the radial direction and conical in the axial direction and comprises a rear end face 17, closest to the parachute device 7, and front end face 19, closest to the payload 6 (FIG. 7). The rear end face 17 comprises the hollow bushing 18, in which the fixing ring is arranged for fixing of the sector elements 13. On the front end face 19 there is arranged a recessed groove 16 configured for application of a tension ring 15 around the sector elements 13. The tension ring 15 is preferably made of an elastic/resilient material, for example a metallic material, in the form of a metal spring, or a rubber, plastics or composite material, in the form of a plastics spring.

The resilient characteristics of the supporting device 9 are enabled by the slightly conical shape of the sector elements, which means that, once the tension ring 15 is applied around the sector elements 13, the front parts, end faces 19, of the sector elements 13 strive to spring out in the radial direction, i.e. to fall into the recess 10.

Figure 2:
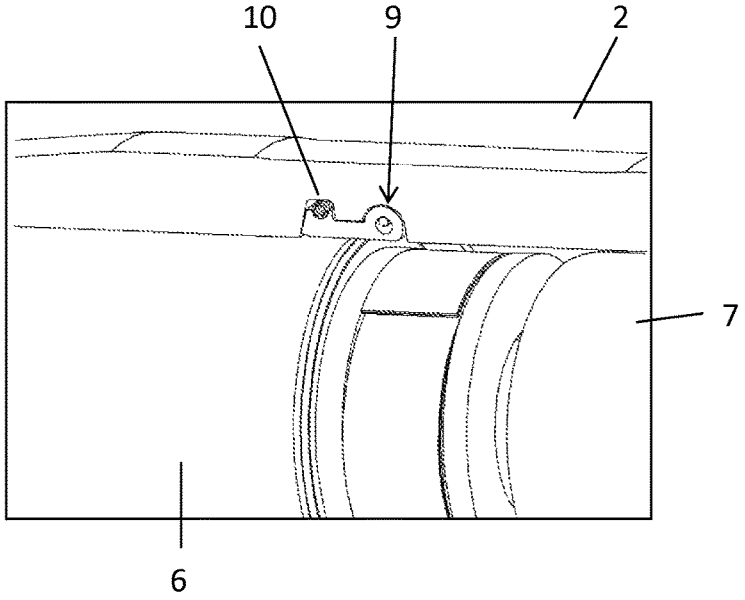
FIG. 2 shows schematically a detailed view of a pretensioned annular supporting device in the retracted position during mounting of a payload, according to FIG. 1.
Figure 3:
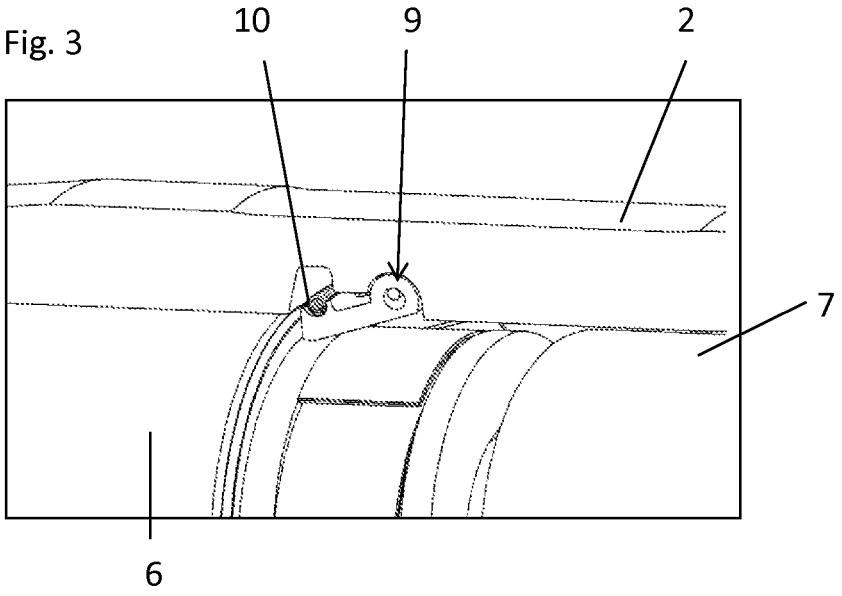
FIG. 3 shows schematically a detailed view of a pretensioned annular supporting device in the extended position during the acceleration phase of the grenade, according to FIG. 1.
Figure 4:
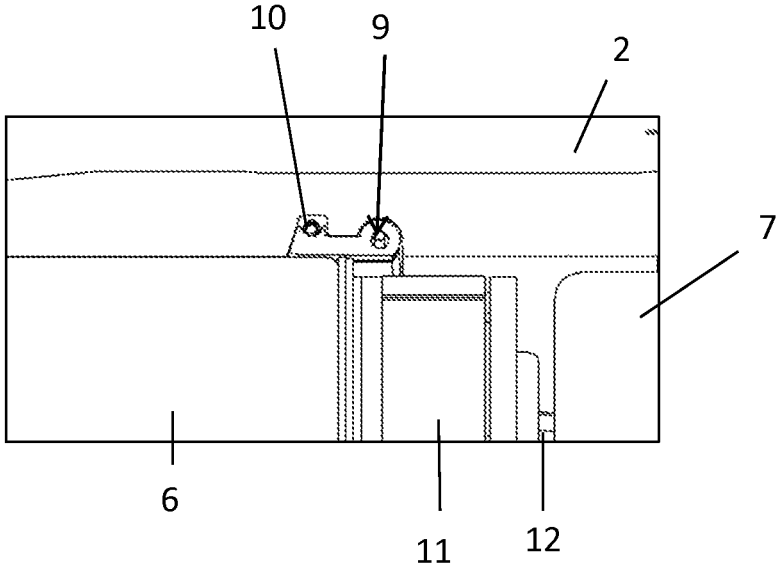
FIG. 4 shows schematically a detailed view of the pretensioned annular supporting device in the retracted position after the acceleration phase of the grenade, according to FIG. 1.

During the various phases of the grenade, the supporting device 9 switches from the extended position from the recess, during the acceleration phase, to the retracted position in the recess, during the division/rotation phase, FIGS. 2-4. The switch between extended and retracted position is determined by factors such as the spring force of the spring ring 15, the spring force of the sector elements 13 and the rotation force of the grenade 1.

When the grenade 1 is over the intended target area, the detonating fuse 4 initiates the dividing charge 5, either by remote control via GPS or by pre-programming, wherein the bursting pressure from the boosting charge 5 presses the payload 6, the parachute device 7 and the grenade bottom 8 backwards in the grenade 1, so that break pins holding the grenade bottom 8 to the grenade case 2 break and the payload 6 is released from the grenade 1 (not shown).

The parachute device 7 is connected to the payload 6 via parachute cords which are arranged in the parachute 7 (not shown). The parachute cords are connected to the payload 6 via a ball-beating-controlled 11 pivot 12 arranged on the rear end face of the payload 6 (FIG. 1).

The invention is not limited to shown embodiments, but can be varied in different ways within the scope of the patent claims.

The invention claimed is:

1. A dividable parachute grenade comprising a grenade casing, a nose cone, a detonating fuse, a dividing charge, a payload, a parachute device, a grenade bottom and a supporting device, wherein the supporting device is annular and comprises pretensioned sector elements fixed to a fixing ring, the fixing ring is received in a recess on an inner side of the grenade casing, the sector elements are pretensioned with a tension ring arranged around the supporting device, the tension ring is received in recessed grooves of the sector elements, wherein, when the sector elements are extended radially, the sector elements and the tension ring are received in a second recess on the grenade casing behind the payload and, when the sector elements are compressed radially, the payload is supported during an acceleration phase of the grenade and the support device stays in the grenade casing after separation of the payload from the grenade casing.

2. Dividable parachute grenade according to claim 1, wherein the sector elements are curved in the radial direction and conical in the axial direction, wherein the sector elements comprise a rear end face, closest to the parachute device, comprising radial hollow bushings for fixing of the sector elements to the fixing ring, and a front end face, closest to the payload, comprising the recessed grooves for application of the tension ring.

3. Dividable parachute grenade according to claim 1, wherein the sector elements are pretensioned with torsion springs arranged in the recess on the inner side of the grenade casing.

* * * * *